US005129166A

United States Patent [19]

Montfort et al.

[11] Patent Number: 5,129,166

[45] Date of Patent: Jul. 14, 1992

[54] FOOT-TIGHTENING DEVICE FOR SKI BOOT

[75] Inventors: Benoit Montfort; Pilon Bruno, both of Annecy, France

[73] Assignee: Salomon S. A., Chavanod, France

[21] Appl. No.: 608,348

[22] Filed: Nov. 2, 1990

[30] Foreign Application Priority Data

Dec. 4, 1989 [FR] France ..... 89 15989

[51] Int. Cl.[5] ..... A43B 5/04

[52] U.S. Cl. ..... 36/117; 36/119

[58] Field of Search ..... 36/117, 118, 119, 120, 36/121

[56] References Cited

U.S. PATENT DOCUMENTS 4,192,087 3/1980 Salomon ..... 36/119
4,575,956 3/1986 Paris ..... 36/119
4,802,290 2/1989 Marega ..... 36/119

FOREIGN PATENT DOCUMENTS 2381483 10/1978 France ..... 36/119
2469885 6/1981 France ..... 36/119
2547206 12/1984 France ..... 36/119
2547487 12/1984 France ..... 36/119
2608903 7/1988 France ..... 36/117

*Primary Examiner*—Paul T. Sewell
*Assistant Examiner*—M. D. Patterson
*Attorney, Agent, or Firm*—Pollock, Vande Sande & Priddy

[57] ABSTRACT

Alpine ski boot comprising a shell base (1), inside which a device for tightening the foot of the skier is installed. The cam of the operating lever comprises sequential, connected first, second, and third surfaces (13*a*, 13*b*, 13*c*), the first surface (13*a*) extending at a relatively short distance (a) from the hinge pin (14), the second surface (13*b*) extending substantially horizontally in the unlocked position and being positioned at a distance (b) from the hinge pin (14) and beneath the latter, this distance being greater than the distance (a) separating this pin and the first surface (13*a*); and the third surface (13*c*) of the cam of the operating lever being positioned at the same distance (b) from the hinge pin (14) as the second surface (13*b*).

11 Claims, 3 Drawing Sheets

FOOT-TIGHTENING DEVICE FOR SKI BOOT

FIELD OF THE INVENTION

The present invention relates to an alpine ski boot comprising a shell base, the interior of which is fitted with a device for tightening the skier's foot.

BACKGROUND OF THE INVENTION

Alpine ski boots fitted with this type of foot-tightening device are already known. The device is provided so as to exert adjustable pressure in order to press the skier's foot against the inner wall of the shell base of the boot during skiing, in order to improve the contact between the foot and the shell base and, thus, to increase the precision with which skiing is performed. In these conventional boots, the tightening device comprises an operating lever mounted on the upper part of the shell base and capable of being adjusted to two positions: an upper, unlocking position causing the loosening of the foot within the shell base, and a lower, locking position in which the foot is tightened within the shell base. The unlocked position of the operating lever is advantageous to the skier, since it enables him to decompress his foot when he stands in a waiting line or walks in his boots. Then, when the skier lowers the operating lever into the locked position, the initial tightening of his foot is automatically restored, without having to screw or unscrew any component whatever.

Among the foot-tightening devices known to date, the one described in Applicant's Patent of Addition FR-A-2 547 487 comprises a element for exerting pressure on the foot, which extends along a slipper in which the skier's foot is inserted and which is designed to tighten this foot against the wall of the shell base. This pressure-generation element is constituted by a strap whose lower end is attached to the shell base and whose upper end is connected to a device strap tension-adjustment device. This device is constituted by a nut screwed on a threaded sleeve engaged in a manner allowing it to slide, while being unitary in rotation on an operating shaft extending horizontally and transversely within the upper part of the shell base. This operating shaft is mounted in rotation on the shell base and is connected, on the outside of the shell, to the operating lever which is articulated on the operating shaft around a pin perpendicular to this shaft. Consequently, the position of the tension-adjustment nut of the strap transverse to the shell base may be adjusted so as to change the force of the tightening stress exerted by the strap on the foot, by causing the operating shaft and lever, and consequently the threaded sleeve, to turn once this lever has been put in its upper, unlocking or loosening position.

The adjustable foot-tightening device has a major disadvantage, namely that the adjustment of tightening-stress intensity is performed by successive approximations requiring that the operating lever be preliminarily placed each time in its upper, unlocked position. In other words, when the skier wishes to adjust foot-tightness, he raises the operating lever into the upper unlocked position, then causes the operating lever and shaft to turn so as to draw the adjustment nut into a new position, and finally depresses the operating lever into the lower locking position in which his foot is tightened within the boot. If the tightening of the foot thus obtained is not suitable, he repeats the preceding operation a certain number of times until the desired tightening intensity is achieved.

SUMMARY OF THE INVENTION

The present invention concerns improvements incorporated into this device for the purpose of simplifying the tightening-adjustment operation.

For this purpose, this alpine ski boot comprising a shell base fitted on the inside with a device for tightening the skier's foot, this device comprising at least one element intended to exert pressure on the foot and whose upper end is connected to a nut screwed on a threaded tightening-adjustment element which extends horizontally and transversely inside of the upper part of the shell base, which is mounted in rotation so as to slide horizontally and transversely on this shell base, which passes through an opening in a wall of the shell base, and which is connected, on the outside of the shell base, to an operating lever hinged around a pin perpendicular to the axis of the threaded adjustment element, the operating lever forming, in the area in proximity to its axis of articulation, a cam controlling the movement of the threaded adjustment element, is characterized by the fact that the cam of the operating lever comprises first, second, and third surfaces which are attached to each other in succession, the first surface of the operating lever being extended at a relatively short distance from the hinge pin and being positioned vertically at a distance from the outer surface of the wall through which the threaded adjustment element passes when the lever is placed in an unlocked position, the second surface of the cam of the operating lever extending substantially horizontally in the unlocked position at the lower end of the lever, thus forming a dihedral angle of approximately 90° with the first surface, while being positioned at a distance b from the hinge pin and beneath it, this distance b being greater than the distance a between this pin and the first surface, and the third surface of the cam of the operating lever being positioned at the same distance from the hinge pin as the second surface and extending, in the unlocked position, from the second position while sloping upward and outward from the boot so as to form an obtuse dihedral angle.

BRIEF DESCRIPTION OF THE DRAWINGS

As illustrative examples, several embodiments of the present invention will now be described with reference to the attached drawings in which.

DESCRIPTION OF THE PREFERRED EMBODIMENTS

Figure 1:
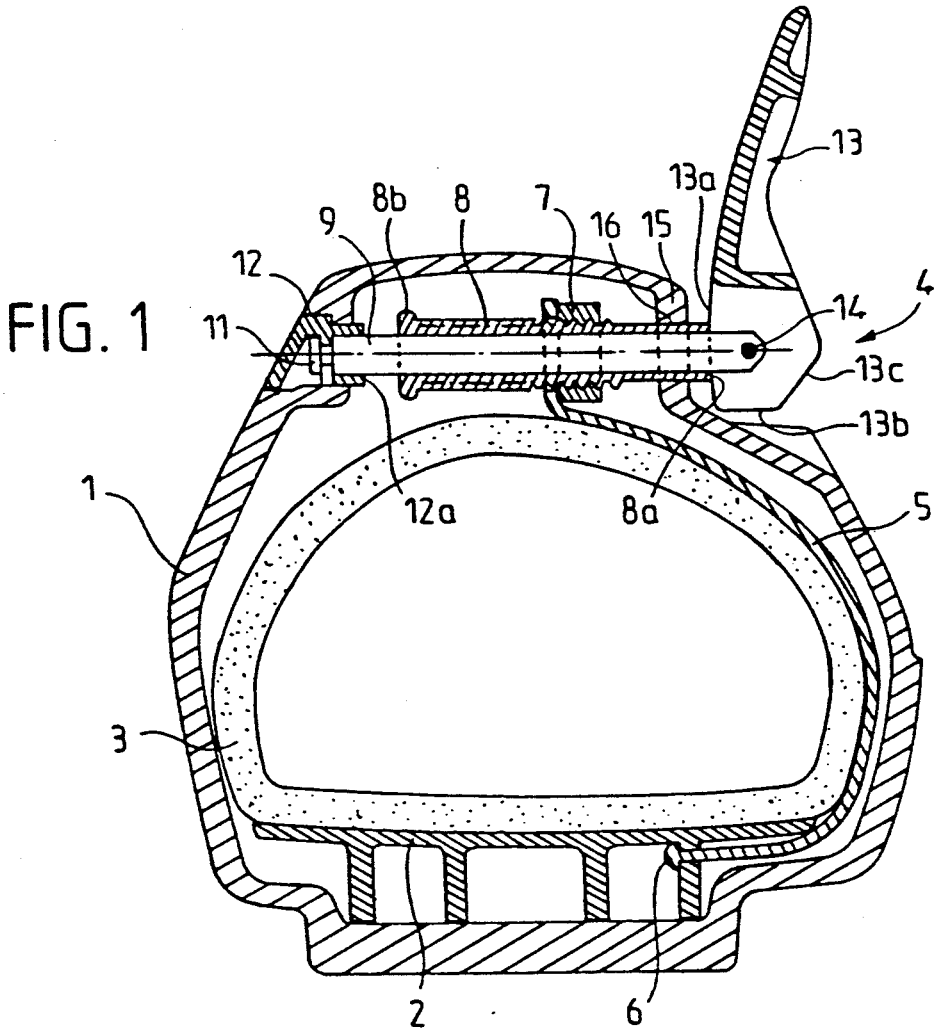
FIG. 1 is a vertical cross-section view of an alpine ski boot fitted with a foot-tightening device according to the invention, the operating lever being in the upper, unlocked position, i.e., foot-loosening position.

The alpine ski boot according to the invention, shown in partial view on FIGS. 1 to 5, comprises a shell base 1 made of a rigid or semi-rigid plastic material, in the lower part of which an inner sole 2 is inserted. A slipper 3 made of a flexible material into which the skier's foot is inserted is installed inside the shell base 1, on the inner sole 3. The boot is equipped with an adjustable foot-tightening device 4 which comprises, inside the shell base 1, a single pressure-generating element, in this case a strap 5. This embodiment is not, however, limiting, since the foot-tightening device could also comprise two pressure-generating elements set transversely opposite each other, as will be described below. The strap 5, made of a relatively flexible material, is fastened by its lower end to the lower part of the shell base 1, more specifically to a lower anchoring point 6. Beginning at this lower anchoring point 6, the strap 5 extends upward on the outside of the slipper 3, while following the contour of the latter. The pressure-generation strap 5 may be in direct contact with the slipper 3, or, according to a preferred embodiment, intermediate support elements (not shown) may be interposed between the strap 5 and the slipper 3 so as to better distribute the pressure exerted on the slipper 3 by the strap 5. This pressure-generating strap 5 is connected, by its upper end, to a nut 7 positioned above the slipper 3 and which may be moved horizontally and transversely. For this purpose, the nut 7 is engaged on a tightening-adjustment element 8 constituted by a transverse threaded sleeve mounted so as to slide on a smooth, transverse operating shaft 9. The sleeve 8 is fastened so as to turn on the operating shaft 9 using any suitable means, for example by making one transverse section of the shaft non-circular (e.g., square or rectangular) over all or a part of its length, this non-circular section being engaged in a section of the same shape as the bore of the threaded sleeve 8, as shown more specifically in FIG. 3. One end 11 of the operating shaft 9, in the present instance its left end, is mounted so as to rotate, while being prevented from moving in axial translational motion, in a housing in the upper left part of the shell base 1. This end 11 may a head retained axially, as shown in the drawing. The other end of the operating shaft 9, i.e., its right end, is connected, on the outside of the shell base 1, to the end forming the cover of an operating lever 13, which is hinged, on the extreme right-hand part of the operating shaft 9, around a pin 14 perpendicular to this shaft. The portion of the lever 13 close to the hinge pin 14 is engaged in a recess formed in the upper right-hand part of the shell base 1 and which is bounded by an upper vertical wall 15 of the shell base 1 and a lower wall sloping downward and outward. The vertical wall 15 has an opening 16 whose axis is transverse and through which pass the extreme right-hand part of the threaded sleeve 8 whose diameter matches that of the opening 16, and the extreme right-hand part of the operating shaft 9. The vertical wall 15 comprises a vertical outer surface 15*a* acting as a temporary or permanent support surface for the lever 13, as will be explained below.

Figure 2:
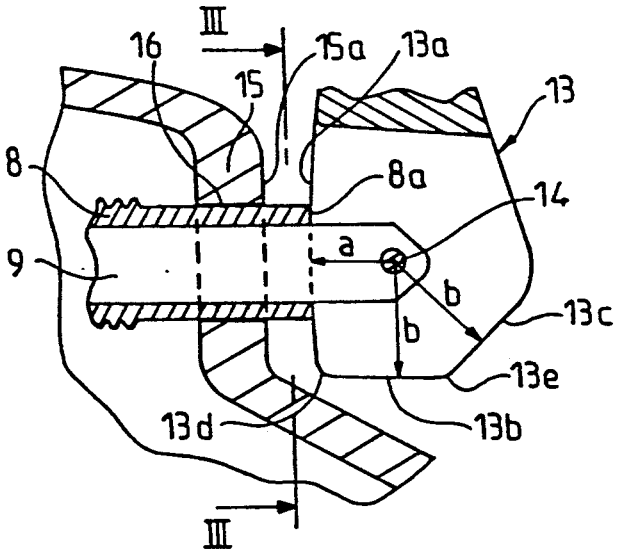
FIG. 2 is a detail cross-section view, on an enlarged scale, of the part of the tightening device in proximity to the hinged end of the operating lever.
Figure 3:
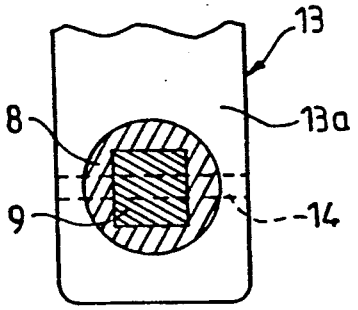
FIG. 3 is a vertical section view along line III—III in FIG. 2.

In its area around the hinge pin 14 and in the area of the outer frontal surface 8*a* of the threaded sleeve 8, the lever 13 forms a cam controlling the sliding movement of the threaded sleeve 8 constituting the foot-tightening adjustment element. This cam comprises three surfaces which are connected one to the other in succession, i.e., surfaces 13*a*, 13*b*, and 13*c*. In the unlocked position, as shown in FIGS. 1 and 2, the lever 13 extends substantially vertically, as is the case for the first cam surface 13*a*, which extends at a short distance from the outer surface 15*a* of the vertical wall 15. This first cam surface 13*a* may be substantially flat, as illustrated in the drawing, or it may embody any other shape. This first cam surface 13*a* is located at a relatively short distance from the hinge pin 14. In the unlocked position, the outer frontal surface 8*a* of the threaded sleeve 8 projecting outward from the shell base 1 through the opening 16 in its wall 15, is in contact with the first surface 13*a* of the cam of the lever 13, as shown in FIGS. 1 and 2; or it is positioned in proximity to the latter and is subject to the action of the pressure-generating strap 5, which is then in the released position.

In the unlocked position, the second surface 13*b* of the cam of the operating lever 13 extends substantially horizontal to the lower end of the lever 13, while forming, together with the first surface 13*a*, a dihedral ridge 13*d* which may be rounded and at the tip of which the angle formed is approximately 90°. This surface is located at a distance b from the hinge pin 14 and beneath it, distance a being greater than distance a between this pin and the first surface 13*a*.

A third cam surface 13*c* follows the second surface 13*b*; this third surface is substantially flat and is located at the same distance b from the hinge pin 14 as the second cam surface 13*b*. In the unlocked position, this third cam surface 13*c* extends from the second horizontal cam surface 13*b* while sloping upward and toward the exterior of the boot, and the two cam surfaces 13*b* and 13*c* form an obtuse dihedral ridge angle 13*e*, which may be rounded. In the unlocked position illustrated in FIGS. 1 and 2, the threaded sleeve 8, and thus the nut 7 which it carries, are maximally offset to the right in the drawing, the sleeve 8 being stopped, its outer frontal surface or right-hand end 8*a* being pressed against the first surface 13*a* of the cam of the operating lever 13 by means of the action of the strap 5, which is then released, thereby exerting no pressure on the slipper 3. The left-hand end 8*b* of the threaded sleeve 8, i.e., its inner frontal surface, is then at a distance from the inner surface 12*a* of the housing 12.

Figure 4:
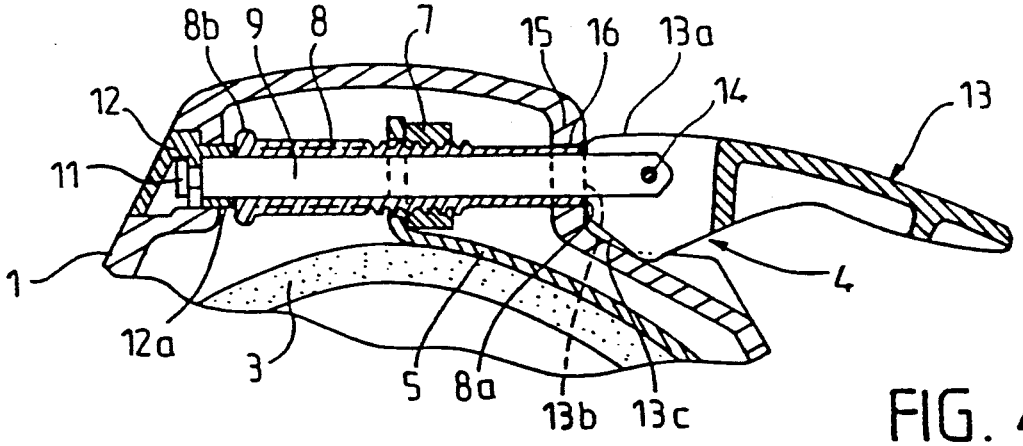
FIG. 4 is a vertical cross-section view of the upper part of the boot, the tightening device being illustrated with the operating lever in the intermediate position of adjustment of tightening intensity.
Figure 6:
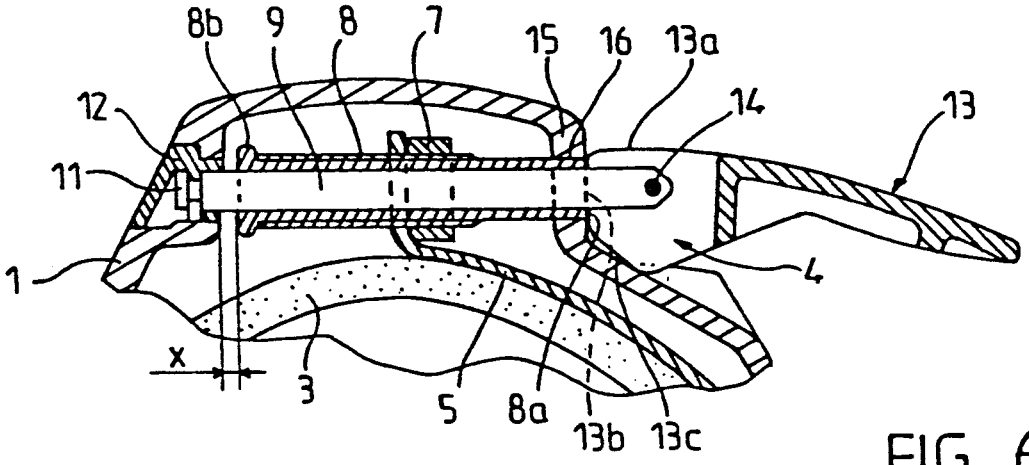
FIG. 6 is a partial vertical cross-section view illustrating a variant of the foot-tightening device.

The lever 3 may be lowered from its vertical unlocked position, illustrated in FIG. 1, into an intermediate tightening-adjustment position, in which it is substantially horizontal, as shown in FIG. 4. In this locking position, the lever 13 may actually be horizontal, or it may form a slight angle with the horizontal. Following this clockwise pivoting motion of the lever 13 of approximately 90°, the second cam surface 13*b* is drawn into a vertical position, as illustrated in FIG. 4. During this movement, the ridge 13*d* between the first cam surface 13*a* and the second cam surface 13*b* comes into contact, at a given instant, with the outer surface 15*a* of the vertical wall 15; during the continued pivoting movement of the lever 13, this ridge 13*d* rests for support on the wall 15, thereby generating a tractive force exerted outward on the operating shaft 9. The resulting movement of the operating shaft 9 is made possible by the relative flexibility of the area in the shell base 1 where the housing 12 is formed, this housing being able to give somewhat transversely. At the end of the pivoting movement of the lever 13, the second cam surface 13*b* comes into contact with the outer frontal surface 8*a* of the threaded sleeve 8. Because this second surface is located at distance b from the hinge pin 14, this distance being greater than distance a between the first cam surface 13*a* and this pin 14, this surface 13*b* pushes the threaded sleeve to the left in the drawing, i.e., toward the interior of the shell base, the sleeve 8 then sliding until it reaches its end position, as shown in FIG. 4. In this position, the inner frontal surface, or left-hand end 8*b* of the threaded sleeve 8, may be supported against the inner surface 12*a* of the lower part of the shell base 1 where the recess 12 is formed, as shown in FIG. 4, or else a slight play x may be provided for between them, as illustrated in FIG. 6. In the first case, the length of the threaded sleeve 8 is equal to the distance between the outer vertical surface 15*a* of the wall 15 and the inner surface 12*a* of the housing 12; while in the second case, it is less than this distance. This play x facilitates the passage of hard spots when the ridge 13*d* or 13*e* slides on the outer surface 15*a* of the vertical wall 15, because the wall of the housing 12 is capable of slight inward give, in the direction of the inner frontal surface 8*b* of the threaded sleeve 8. It should also be noted that, in the tightening-adjustment position, the second cam surface 13*b* of the lever 13 is also in contact with the outer surface 15*a* of the wall 15, or is positioned at a short distance from the latter.

In the tightening-adjustment position illustrated in FIG. 4, the intensity of the foot-tightening stress can be adjusted by causing the lever 13, the operating shaft 9, and the threaded sleeve to turn in one direction or the other around their common axis. The rotation of the threaded sleeve 8 causes the translational motion, on this sleeve, of the nut 7, which is prevented from rotating by the strap 5; consequently, a relatively strong tractive force exerted by the nut 7 on this strap 5, as well as a relatively strong pressure exerted by the strap 5 on the slipper 3, are obtained.

Figure 5:
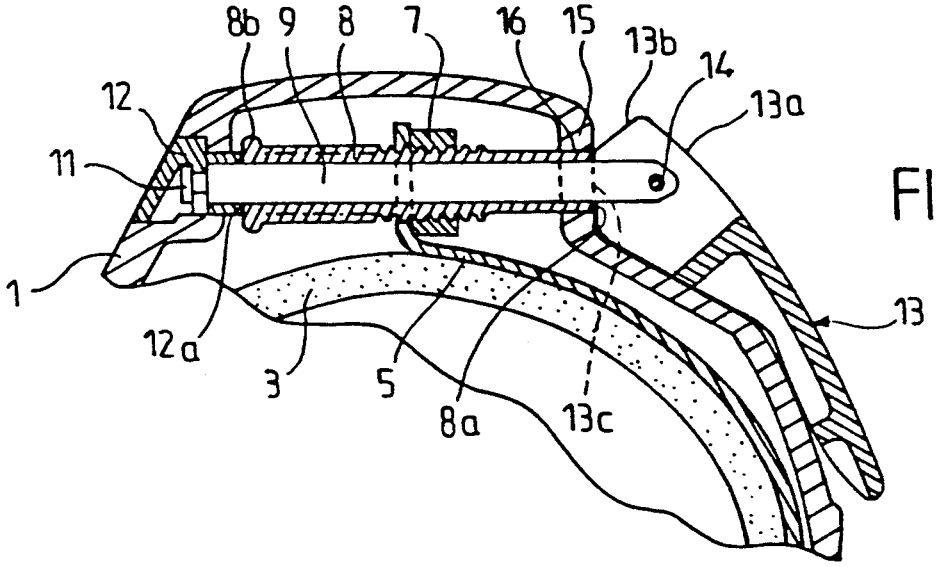
FIG. 5 is a vertical cross-section view of the upper part of the boot, the tightening device being shown with the operating lever in the locked position.

After the skier has thus adjusted the force of the tightening exerted on his foot inside the shell base 1, he causes the operating lever 13 to pivot downward into the lower locking position shown in FIG. 5. In this position, it is the third cam surface 13*c* which comes into contact with the outer frontal surface 8*a* of the threaded sleeve 8, after the temporary deformation of the wall of the housing 12 resulting from the sliding movement along the outer surface 15*a* of the wall 15 of the ridge 13*e* formed between the second and third cam surfaces 13*b*, 13*c*. Because the third cam surface 13*c* is located at the same distance b from the hinge pin 14 as the second cam surface 13*b*, the result is that, in the locked position, the nut 7 occupies the same position in the transverse direction as the position which it occupies at the end of the tightening adjustment operation. Accordingly, in the locked position of the lever 13, the pressure exerted on the slipper 3 by the tightened strap 5 is the same as the pressure obtained when the lever 13 was placed in its horizontal tightening-adjustment position. Furthermore, the angle formed between the third cam surface 13*c*, which is at that moment in the vertical position, and the rest of the operating lever 13, is chosen so that the lever slopes downward and outward from the boot, while being tightly pressed against the wall of the shell base 1. In other words, the dihedral angle formed by the second and third cam surfaces 13*b*, 13*c* is equal to the supplementary angle between the horizontal position and the lower inclined locked position of the lever 13.

According to a variant, a spring may be provided to facilitate the outward sliding movement of the threaded sleeve 8 when the device is placed in the unlocked position, as shown in FIG. 1. This spring may be a compression spring positioned between the inner, or left-hand, frontal surface 8*b* of the threaded sleeve 8 and the inner surface 12*a* of the shell base 1, where the housing 12 is provided for retention of the head 11, of the operating shaft 9.

Figure 7:
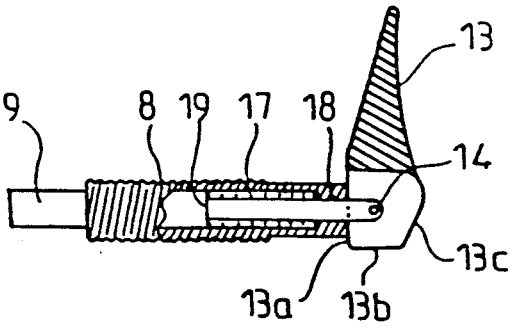
FIG. 7 is a section view of another variant of the tightening-adjustment device.

According to another variant, illustrated in FIG. 7, the elastic outward return of the threaded sleeve 8 may be obtained using a compression spring 17 housed inside the threaded sleeve, which is sealed at its outer, or right-hand end, by an end-piece 18 through which the operating shaft 9 passes. At its left-hand end, the spring 17 rests for support on the operating shaft, and, at its right-hand end, on the end-piece 18 of the sleeve 8. This arrangement makes it possible, using the compression spring 17, to continuously push the sleeve 18 back elastically against one of the three cam surfaces 13*a*, 13*b*, 13*c* of the operating lever 13, depending on the position of the latter.

Figure 8:
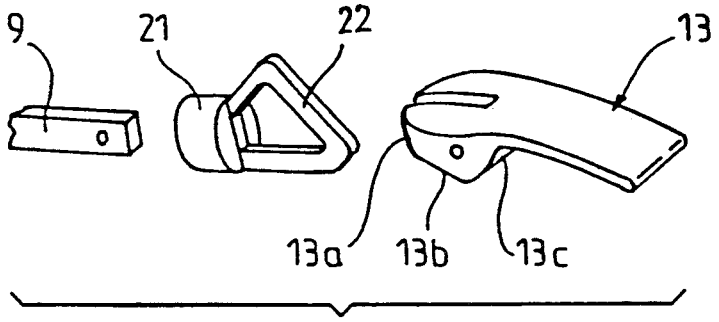
FIG. 8 is an exploded perspective view of a variant of the connection between the operating lever and the adjustment shaft.

In the variant shown in FIG. 8, the device comprises a sheath 21 fitted over the operating shaft 9, while being unitary in rotation with this shaft. An axial bore having a cross-section corresponding that of the operating shaft 9 is drilled on each side of the sheath 21. This sheath is extended outward by an ear 22, through which the hinge pin 14 of the lever 13 on the operating shaft 9 passes freely. The sliding sheath 21 protects the device from dirt.

Figure 9:
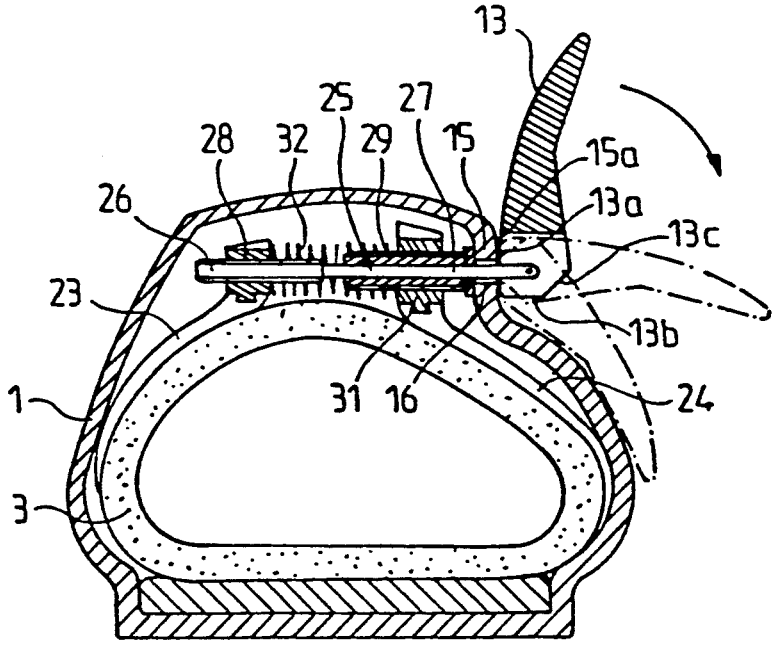
FIG. 9 is a vertical cross-section view of an alpine ski boot fitted with a variant of a foot-tightening device comprising two foot pressure-generating elements.

In the variant in FIG. 9, the foot-tightening device comprises, on the side of the shell base 1, two pressure-generating elements 23, 24 constituted by rigid or semi-rigid support plates in contact with the upper surfaces of the slipper 3 and on both sides of the latter. In this case, the foot-tightening adjustment element comprises a horizontal, transverse shaft 25 whose inner, or left-hand, end part, the diameter of which may be greater than its right-hand part 27, is threaded. This threaded part 26 is screwed into a nut 28 unitary with the upper part of the left-hand support plate 23. The right-hand part of the tightening-adjustment shaft 25 has a non-circular cross-section which is, for example, square or rectangular, and it carries a coaxial threaded sleeve 29 having a bore incorporating the same cross-section as that of part 27 of the shaft 25. The sleeve 29 is thus connected in rotation to the shaft 25, but a relative sliding movement can occur between the part 27 of the shaft 25 and the sleeve 29. The threaded sleeve 29 is screwed into a nut 31 unitary with the upper part of the right-hand support plate 24. The thread pitches of the threaded part 26 of the shaft 25 and of the threaded sleeve 29 are equal, but run in opposite directions. A compression spring 323 may be installed around the shaft 25 between the two nuts 28, 31, thereby tending to keep these nuts at a distance one from the other.

The right-hand part 27 of the shaft 25 extends to the outside of the vertical wall 15 of the shell base 1 and passes through the opening 16. At its outer end, the shaft 25 is attached to the operating lever 13 by means of the transverse hinge pin 14. As in the embodiment previously described, the lever 13 has, near its hinge pin 14, the cam constituted by its three surfaces 13*a*, 13*b*, and 13*c*, which are produced in identical fashion.

In the unlocked position, as illustrated in FIG. 9, the two nuts 28, 31 are separated by the maximum possible distance, so that the support plates 23, 24 do not tighten over the slipper 3. When the skier wishes to change the tightness exerted on his foot, he lowers the lever 13 into a substantially horizontal position, as shown in chain-dotted lines. At this moment, the lever 13 is supported by its second cam surface 13*b* against the outer surface 15*a* of the wall 15. Because this second cam surface 13*b* is located at distance b from the hinge pin 14, this distance being greater than distance a between the first cam surface 13*a* and this pin, the adjustment shaft 25 is drawn outward slightly, so that the nut 28 is drawn somewhat closer to the nut 31. The two support plates 23, 24 then tighten around the slipper while exerting a given tightening force. To change this tightening force, the skier uses the lever 13 in the substantially horizontal position to turn the adjustment shaft 25 on itself. This rotational movement causes the two nuts 28, 31 to move in translational motion on the threaded part 26 of the shaft 25 and on the threaded sleeve, respectively, while they draw closer together or move farther apart, depending on the direction of rotation. Once the desired tightening force has been obtained, the skier lowers the lever 13 into the lower inclined locking position. It is thus the third cam surface 13*c* of the lever 13 which comes into contact with the outer surface 15*a* of the wall 15, and, as in the embodiment previously described, in this locked position, the skier obtains the same value of the force of the tightening pressure exerted on his foot as that obtained at the end of the tightening-adjustment operation.

In all of the embodiments of the invention previously described, it was indicated that, in the locked position, the operating lever 13 slopes downward, and that, in the unlocked position, it is substantially vertical. This arrangement is not, however, a limiting one. The invention also applies to the case in which the foot-tightening device comprises a lever occupying different locked and unlocked positions, particularly in the case in which, in the locked position, the lever extends substantially horizontally above the shell base. In this instance, the passage from the locked to the unlocked position is effected by pivoting the lever downward.

What is claimed is:

1. Alpine ski boot comprising a shell base (1) fitted on the inside with a device for tightening the skier's foot, said device comprising at least one element (5; 23, 24) designed to exert pressure on the foot and having an upper end connected to a nut (7; 28, 31) screwed on a threaded tightening-adjustment element (8; 26, 29) which extends horizontally and transversely inside an upper part of said shell base (1), said device being mounted for rotational sliding movement horizontally and transversely on said shell base (1), said device passing through an opening (16) in a wall of said shell base (1) and being connected, on an exterior of said shell base, to an operating lever (13) hinged around a pin (14) perpendicular to an axis of said threaded adjustment element (8, 26), said operating lever (13) having a portion forming, in an area adjacent to said hinge pin (14), a cam controlling movement of said threaded adjustment element (8; 26 29), wherein said cam of said operating lever comprises sequential, connected, first, second, and third substantially flat surfaces (13*a*, 13*b*, 13*c*) said first surface (13*a*) (13) extending at a relatively short distance (a) from said hinge pin (14) and being positioned vertically at a distance from the outer surface (15*a*) of the wall (15) through which said threaded adjustment element (8, 26) passes when said lever (13) is in unlocked position, said second cam surface (13*b*) extending substantially horizontally in said unlocked position at a lower end of said lever (13), thus forming a dihedral angle of approximately 90° with said first surface (13*a*), while being positioned at a distance (b) from and beneath said hinge pin (14), said distance (b) being greater than said distance (a) between said pin and said first surface (13*a*), and said third cam surface (13*c*) of said operating lever (13) being positioned at said same distance (b) from said hinge pin (14) as said second surface (13*b*) and extending, in said unlocked position, from said second surface (13*b*) while sloping upward and outward from said boot so as to form an obtuse dihedral angle.

2. Alpine ski boot according to claim 1, wherein said threaded adjustment element is constituted by a sleeve (8) mounted for sliding movement on a horizontal, transverse operating shaft (9) having a first end (11) which is held axially in position and a second, outer end connected to said operating lever (13) by means of said hinge pin (14).

3. Alpine ski boot according to claim 2, wherein said threaded sleeve (8) and said inner coaxial operating shaft (9) pass together through said opening in said wall (15) of said shell base (1), the diameter of said opening (16) being substantially equal to that of said threaded sleeve (8).

4. Alpine ski boot according to claim 2 or 3, wherein said operating shaft (9) has a non-circular cross-section and wherein the bore of said threaded sleeve (8) has the same non-circular cross-section.

5. Alpine ski boot according to claim 2 or 3, wherein the length of said threaded sleeve (8) is equal to the distance between the outer vertical surface (15*a*) of said wall (15), through which said threaded sleeve (8) and said operating shaft (9) pass, and the inner surface (12*a*) of said shell base, at the site of a housing (12) in which the end of said operating shaft (9) is held axially in position.

6. Alpine ski boot according to claim 2 or 3, wherein the length of said threaded sleeve (8) is smaller than the distance between said outer vertical surface (15*a*) of said wall (15) through which said threaded sleeve (8) and said operating shaft (9) pass, and said inner surface (12*a*) of said shell base, at the site of said housing (12), in which the end of said operating shaft (9) is held axially in position.

7. Alpine ski boot according to claim 6, comprising a compression spring between the inner frontal surface (8*b*) of said threaded sleeve (8) and said inner surface (12*a*) of said shell base (1) at the site of the housing (12), so as to ensure axial retention of the end of said operating shaft (9), in order to draw elastically said threaded sleeve (8) outward.

8. Alpine ski boot according to claim 7, wherein said compression spring (17) is housed inside the threaded sleeve (8), which is sealed at its outer end by an end-piece (18) through which said operating shaft (9) extends, and wherein said spring (17) has one end supported on a shoulder (19) provided on said operating shaft (9), and a second end supported on said end-piece (18) of said threaded sleeve (8).

9. Alpine ski boot according to claim 2 or 3, comprising a sheath (21) fitted over said operating shaft (9)

while being unitary in rotation with said shaft, said sheath (21) extending outward by an ear (22) through which said hinge pin (14) of said operating lever (13) on said operating shaft (9) freely passes.

10. Alpine ski boot according to claim 1, wherein said foot-tightening adjustment element is constituted by a horizontal, transverse shaft (25), having an inner end piece (26) threaded and screwed into a nut (28) unitary with the upper part of a pressure-generating element (23), and wherein said shaft (25) extends through said opening (16) in said wall (15) of said shell base and is hinged by its outer end onto said operating lever (13), around said hinge pin (14).

11. Alpine ski boot according to claim 10, wherein said shaft (25) comprises an outer end piece (27) of non-circular cross-section on which a coaxial threaded sleeve (29) is fitted for sliding movement, said sleeve incorporating a bore having a same cross-section as said outer end-piece (27) of said shaft (25), so as to be drawn in rotation by said shaft, and wherein said threaded sleeve (29) is screwed in a second nut (31) unitary with an upper part of a second pressure-generating element (24) located opposite said first pressure-generating element (23), thread pitches of said threaded part (26) of said shaft (25) and of said threaded sleeve (29) being equal but running in opposite directions.

* * * * *